US006670875B2

(12) United States Patent
Bircann et al.

(10) Patent No.: US 6,670,875 B2
(45) Date of Patent: Dec. 30, 2003

(54) MAGNETICALLY-EFFICIENT SOLENOID FOR A LINEAR ACTUATOR

(75) Inventors: Raul A. Bircann, Penfield, NY (US); Dwight O. Palmer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 181 days.

(21) Appl. No.: 09/781,646

(22) Filed: Feb. 12, 2001

(65) Prior Publication Data

US 2001/0032633 A1 Oct. 25, 2001

Related U.S. Application Data

(60) Provisional application No. 60/184,514, filed on Feb. 24, 2000.

(51) Int. Cl.[7] ..... H01F 7/08
(52) U.S. Cl. ..... 335/220; 251/129.15
(58) Field of Search ..... 335/256, 276, 335/280, 220–229; 251/129.01–129.21

(56) References Cited

U.S. PATENT DOCUMENTS 4,278,959 A * 7/1981 Nishimiya et al. ..... 335/262
4,746,888 A * 5/1988 Ichihashi et al. ..... 335/262
5,899,136 A * 5/1999 Tarr et al. ..... 92/80

* cited by examiner

*Primary Examiner*—Lincoln Donovan
(74) *Attorney, Agent, or Firm*—Patrick M. Griffin

(57) ABSTRACT

An improved solenoid for providing linear actuation. The outer polepiece of the solenoid is provided with an axial journal bearing for supporting an actuating shaft extending from the solenoid armature. Radial tolerance between the bearing inner bore and the shaft is as small as in practically possible, which feature permits elimination of the prior art portion of the guiding sleeve extending into the outer polepiece, thereby retaining frictional losses with only the remaining sleeve portion in the inner polepiece. Small prior art air gaps at interfaces 42,44 between the polepieces and the housing are eliminated to minimize reluctance of the magnetic circuit. A significant increase in actuating force is realized in comparison with a prior art solenoid actuator.

6 Claims, 3 Drawing Sheets

MAGNETICALLY-EFFICIENT SOLENOID FOR A LINEAR ACTUATOR

CROSS-REFERENCE TO RELATED-APPLICATIONS

This application claims the benefit of U.S. Provisional Application Ser. No. 60/184,514, filed Feb. 24, 2000.

TECHNICAL FIELD

The present invention relates to electric solenoids as used in mechanical linear actuators; more particularly, to such solenoids as may be required to operate without regard to orientation; most particularly to such a solenoid having actuation force maximized by minimization of air gaps in the magnetic pathway within the solenoid.

BACKGROUND OF THE INVENTION

Electric solenoids are well known in electrical engineering and are widely used as actuating components in electromechanical actuators. A typical electric solenoid consists of a plurality of windings of an electric conductor about north and south polepieces. When current is passed through the windings, a characteristic toroidal magnetic field is produced having field lines at the axis which are parallel to the axis. A ferromagnetic armature is slidably disposed in an axial bore in the polepieces. An axial force is exerted by the magnetic field on the armature which tends to displace the armature axially. The strength of such force can be varied by varying the current flowing through the windings. Thus, by attaching the armature to a shaft, a solenoid may be adapted readily to provide linear mechanical actuation of a device to which it is attached. Solenoids are probably the commonest type of such actuators in use today.

The maximum force which may be exerted on the armature is in part a function of the axial size and stability of the cylindrical air gap between the armature and the polepieces. Ideally, the thickness of the air gap is zero, but conversely, the armature must not touch the either of the polepieces. Further, the armature is not spontaneously centered in the bore, and non-axial magnetic vectors within the bore destabilize centering of the armature, resulting in unpredictable variances in the size and shape of the air gap and in the corresponding response of the armature.

It is known in the art to provide a lubricious, non-magnetic, cylindrical sleeve in the air gap to keep the armature centered in both of the polepieces and to function as a journal bearing to facilitate low-friction motion of the armature. Such a sleeve can reduce the centering problem but in itself still contributes to the thickness of the non-magnetic gap between the armature and the polepieces, thus limiting the maximum actuating force of the solenoid. Such a sleeve also has frictional contact, however small, with the armature over the full length thereof, through both polepieces.

Further, because of necessary tolerances between the sleeve and the armature and between the sleeve and the polepieces, the armature may still be unacceptably decentered by gravity if the actuator is used in orientations wherein the actuator axis is inclined more than about 30° from vertical. Thus, prior art solenoid actuators can impose serious engineering design restrictions in their use.

Solenoids are inherently inefficient due to their relatively high radial/axial force ratio. Radial forces on the armature exist because the magnetic field within the windings is fully parallel to the axis of the solenoid only at infinite distances from the axial ends of the windings. At all other locations, because of the magnetic fringing field a significant radial component exists which tends to decenter the armature unpredictably and frictionally against the guiding sleeve. Even in solenoids having the best available lubricious coatings of the guiding sleeve, the ratio of radial-to-axial forces can be as high as 10:1. Because only the axial component of force can be utilized to move the armature axially, the radial forces constitute parasitical friction which must be overcome by the device to perform properly.

What is needed is an improved, efficient solenoid which may be used in any orientation without loss in effectiveness, wherein the thickness of the gap between the armature and the polepieces is minimized and controlled to be substantially cylindrical and wherein the reluctance of the magnetic circuit is minimized.

SUMMARY OF THE INVENTION

The present invention is directed to an improved solenoid for providing linear actuation. The outer polepiece of the solenoid is provided with an axial, self-lubricated, non-magnetic journal bearing for supporting an actuating shaft extending coaxially from the solenoid armature. Preferably, the radial tolerance between the diameters of the bearing inner bore and the shaft is as small as in practically possible without inducing significant drag of the shaft in the bearing. This feature permits elimination of that prior art portion of the guiding sleeve extending into the outer polepiece, thereby reducing frictional losses with the sleeve, and reduction in thickness of the air gap between the armature and the outer polepiece. Further, small prior art air gaps between the pole pieces and the housing are eliminated to reduce reluctance of the magnetic circuit. A significant increase in actuating force is realized in comparison with a prior art solenoid actuator.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings, in which.

DESCRIPTION OF THE PREFERRED EMBODIMENT

Figure 1:
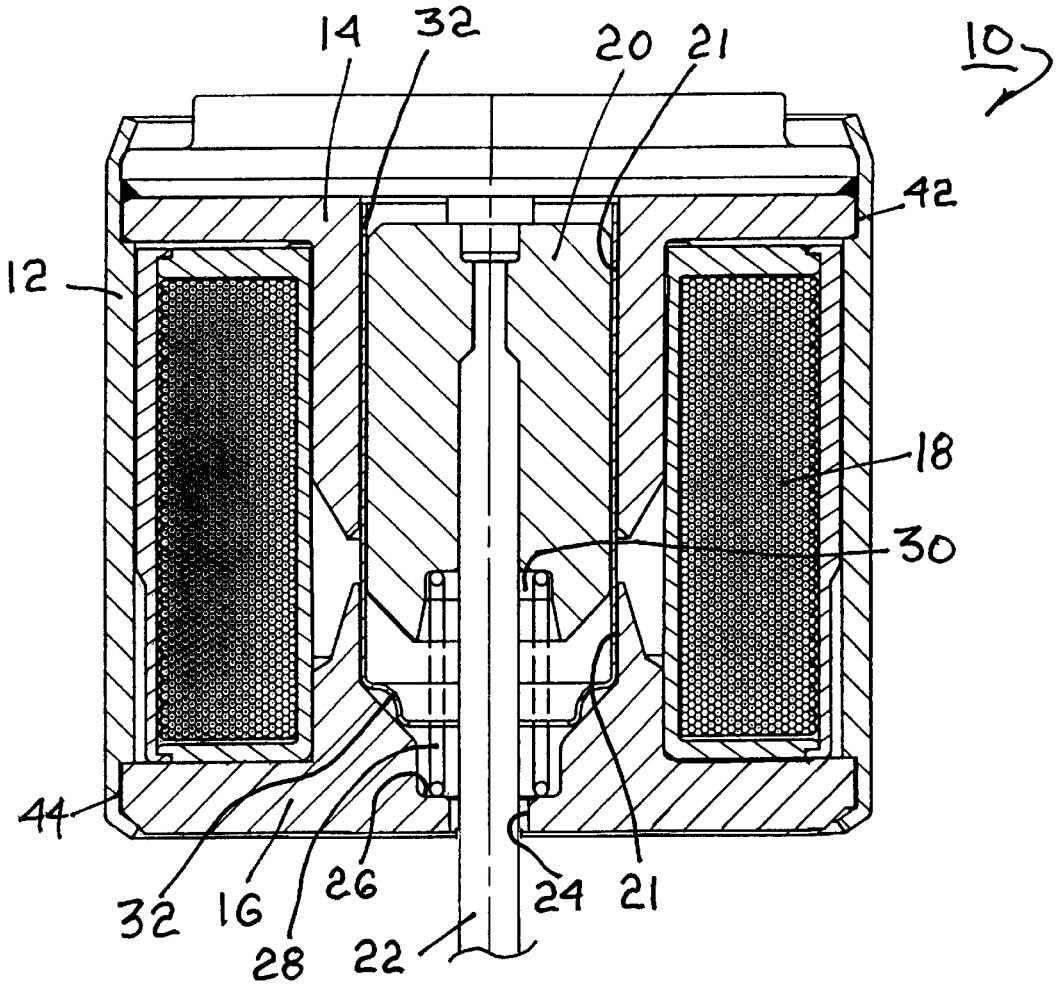
FIG. 1 (PRIOR ART)
FIG. 1 is a cross-sectional view of a prior art solenoid actuator.

The benefits afforded by the present invention will become more readily apparent by first considering a prior art solenoid actuator. Referring to FIG. 1, a prior art actuator 10 includes a housing 12 containing first and second pole pieces 14,16, respectively, and a plurality of windings 18 about the polepieces. A ferromagnetic armature 20 is slidably disposed within a stepped first axial bore 21 in the pole pieces. An actuating shaft 22 is axially disposed and retained within armature 20 and extends from housing 12 via a second axial bore 24 in polepiece 16 for connection to work. Step 26 in bore 21 receives a coil spring 28 disposed in compression between step 26 and a well 30 in armature 20 for biasing the armature into the solenoid. A generally cylindrical non-magnetic sleeve 32 surrounds armature 20 and spring 28 for slidably guiding and centering the armature axially of polepieces 14 and 16. Typically, the sleeve is formed of a non-galling non-ferromagnetic material such as stainless steel or ceramic, and either the sleeve or the armature may be coated with any of various well-known dry lubricants.

Figure 2:
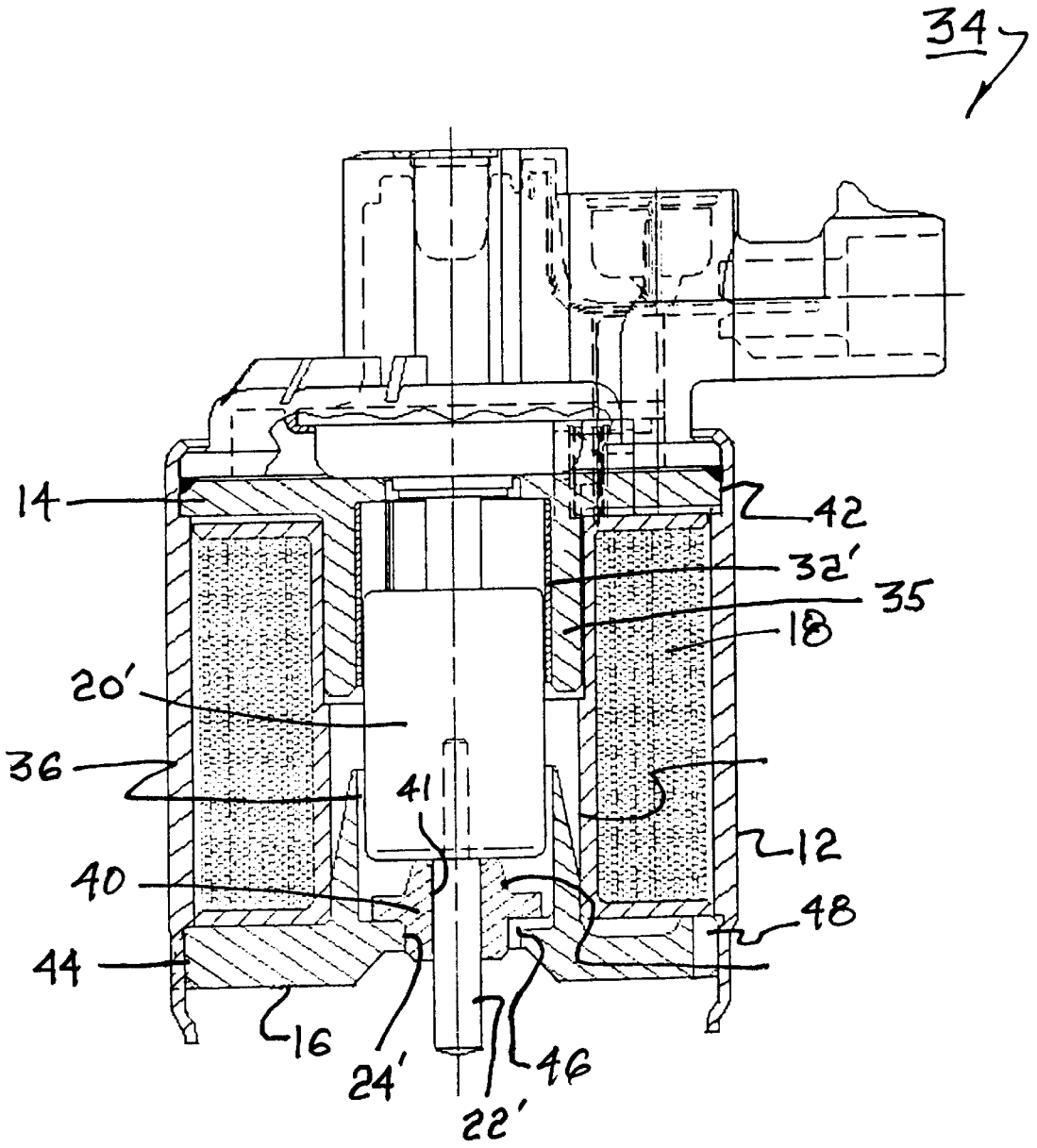
FIG. 2 is a cross-sectional view of a solenoid actuator in accordance with the invention.

Referring to FIG. 2, embodiment 34 of an improved half-sleeve solenoid actuator in accordance with the invention comprises several elements analogous to elements in prior art actuator 10: housing 12, first and second polepieces 14,16, and windings 18. Sleeve 32' is limited in axial length to approximately the length of the axial portion 35 of inner or first polepiece 14. Air gap 36 is shown substantially larger than to scale for illustration purposes; preferably, the distance between outer or second polepiece 16 and armature 20' is on the order of a small fraction of a millimeter to minimize its contribution to magnetic reluctance. A working shaft 22' is press-fit into armature 20'. An axial bore 24' in second polepiece 16, alternative to bore 24 in the prior art actuator, retains a spool bearing 40 for radially supporting shaft 22' in axial motion. As already described, shaft 22' is preferably fitted to the bore in bearing 40 as closely as possible without causing drag on the shaft. Bore 41 in bearing 40 is coated with a permanent dry lubricant such as a fluorocarbon polymer; preferably, bearing 40 is a commercially-available coated non-magnetic metal bearing element, for example, a Norglide bearing available from Saint-Gobain Performance Plastics Corporation, Wayne, N.J., USA, or a Permaglide Plain bearing available from INA Waelzlager Schaeffler GmbH, Herzogenaurach, GERMANY. Preferably, sleeve 32' is also formed from this or a similar material. Preferably, the axial length of bearing 40 is at least 1.5 times the diameter of shaft 22' to minimize wobble of the shaft in the bearing and resulting cocking of the armature in the polepieces.

It is important that bearing 40 be formed of non-ferromagnetic material because the bearing also acts as a fixed stop to limit the travel of the armature. If bearing 40 were ferromagnetic, the armature would become magnetically latched to the bearing, interfering with operation of the actuator.

Because air gap 36 between armature 20' and polepiece 16 is substantially fixed in size and shape by a combination of sleeve 32' and bearing 40, as well as being reduced to a minimum thickness, the armature cannot strike the polepieces. Thus, solenoid actuators in accordance with the invention may be used freely without regard to spatial orientation. This feature can be extremely useful, for example, in fitting an EGR valve into the engine compartment of a vehicle.

The magnetic circuit in the solenoid passes through polepieces 14,16 and housing 12. Any air gap in the magnetic circuit increases reluctance and, consequently, reduces magnetic flux and force potential. Because of the relatively high reluctance of air, compared to magnetic material in the circuit, significant gains in field strength can be achieved by minimizing or, preferably, eliminating all such gaps. Therefore, a solenoid in accordance with the invention is preferably assembled by "Magneforming," a proprietary technique of the Maxwell Magneform Company, San Diego, Calif., USA, wherein ferromagnetic components are thrust together under very high forces produced by magnetic fields. In solenoids 10 and 34, critical interfaces 42,44 exist between first polepiece 14 and housing 12 and between second polepiece 16 and housing 12, respectively. Gaps at these interfaces in improved solenoid 34 may be effectively eliminated, and interface reluctance reduced to substantially zero, through use of the Magneform process, which forces mating components to come into contact with each other in the closest possible relationship short of actual fusion. Magneforming is highly superior to mechanical swaging or staking of the housing to the polepieces as is common in prior art solenoids.

The combination of minimal air gap 36, afforded by centering of the armature in sleeve 32' and bearing 40, and elimination of air gaps at interfaces 42 and 44, allows the highest force potential attainable for a solenoid of any given size.

Because solenoid 34 may be employed in an actuator in any orientation rather than essentially vertically and shaft-down as in prior art solenoid 10, a hazard may be created wherein intrusive moisture or condensation is trapped within the actuator, leading to corrosion and failure. Accordingly, drainage preferably is provided from solenoid 34, for example, via a plurality of inner vents 46 and outer vents 48 radially disposed preferably at 90° spacing in the solenoid.

Figure 3:
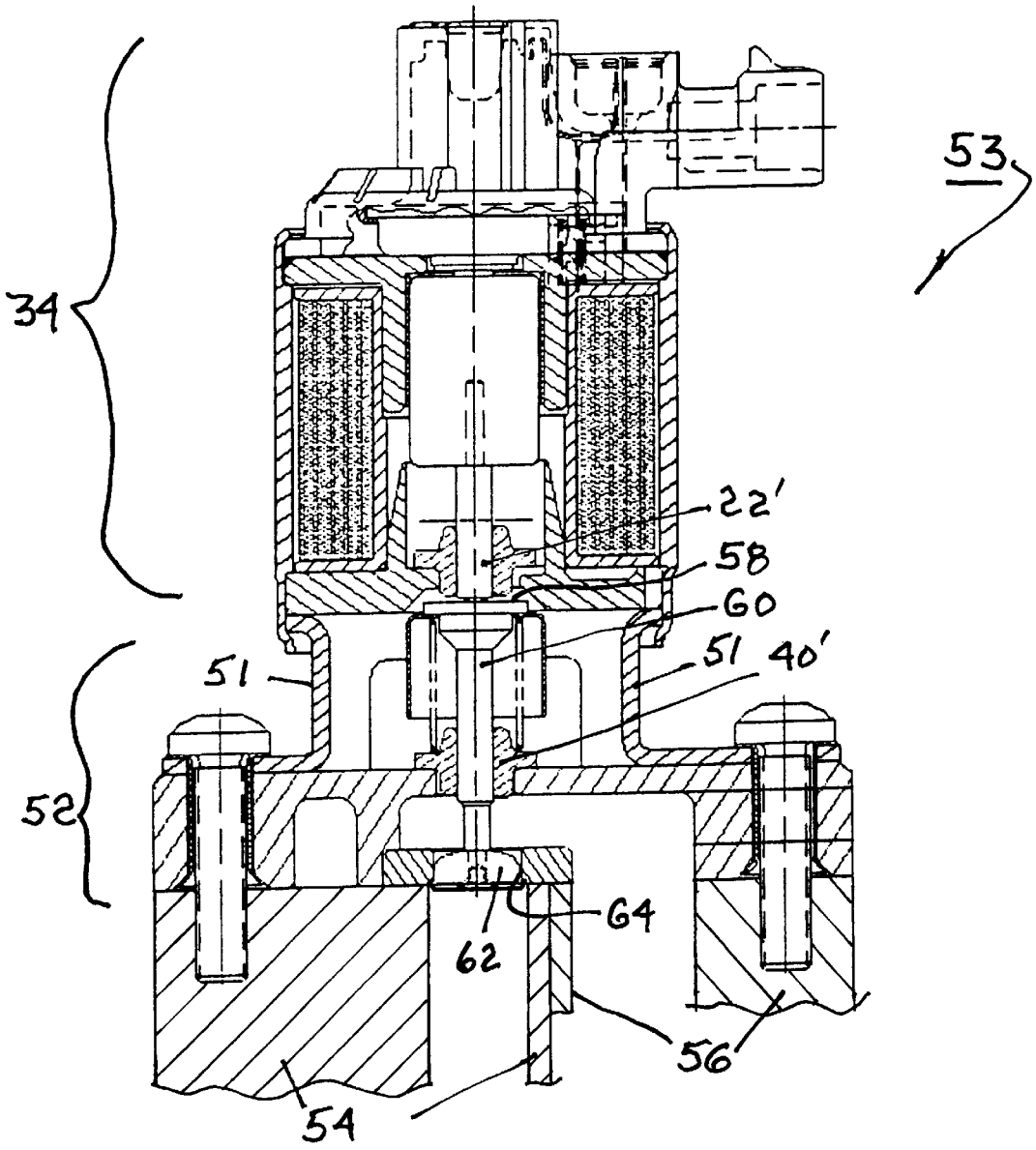
FIG. 3 is a cross-sectional view of an actuator in accordance with the invention operationally attached to an exhaust gas recirculation (EGR) valve on an internal combustion engine.

Referring to FIG. 3, embodiment 34 is shown mounted via standoffs 51 onto an EGR valve 52 to form an EGR valve assembly 53 which is bolted to the exhaust manifold 54 and intake manifold 56 of an internal combustion engine. Shaft 22' engages the outer end 58 of the pintle 60 of valve 52 to open and close valve head 62 from valve seat 64 to selectively admit exhaust gases from exhaust manifold 54 into intake manifold 56 to reduce smog emitted by the engine. Of course, if desired, shaft 22' can be continuous like pintle shaft 22 in FIG. 1 between valve head 62 and armature 20', within the scope of the invention.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A solenoid for providing linear actuation, comprising:

a) first and second polepieces having first and second respective axial bores coaxially disposed along a common axis;

b) an electrical conductor wound around said polepieces in a plurality of turns;

c) a lubricious sleeve disposed entirely within one of said first and second axial bores;

d) an armature slidably disposed in said sleeve;

e) a bearing axially disposed in the polepiece other than the polepiece containing said sleeve; and f) a shaft attached coaxially to said armature and extending through a supportive bore in said bearing, said shaft being axially displaceable by electromagnetic displacement of said armature to provide said actuation.

2. A solenoid in accordance with claim 1 wherein said armature is separated from said polepiece other than the polepiece containing said sleeve by a generally cylindrical air gap.

3. A solenoid in accordance with claim 1 further comprising a housing surrounding said polepieces and said wound conductor, said housing being in intimate contact with said polepieces at interfaces characterized by substantially zero reluctance.

4. A solenoid in accordance with claim 3 wherein said interfaces are formed by magnetic forming.

5. A solenoid in accordance with claim 1 wherein said solenoid is included in an actuator attachable to a device for providing linear actuation to said device.

6. A solenoid in accordance with claim 1 wherein the respective diameters of said bearing bore and said shaft are closely matched.

* * * * *